US005333949A

United States Patent [19]

McGregor

[11] Patent Number: 5,333,949

[45] Date of Patent: Aug. 2, 1994

[54] FILE DRAWER INTERLOCK MECHANISM

[75] Inventor: Dickson J. McGregor, Pembroke, Canada

[73] Assignee: Krueger International, Inc., Green Bay, Wis.

[21] Appl. No.: 956,623

[22] Filed: Oct. 5, 1992

[51] Int. Cl.[5] ..... E05C 7/06

[52] U.S. Cl. ..... 312/221; 312/222

[58] Field of Search ..... 312/216, 220, 221, 217, 312/222

[56] References Cited

U.S. PATENT DOCUMENTS

| | | | |
|---|---|---|---|
| 3,881,793 | 5/1975 | Anderson | 312/217 |
| 3,883,199 | 5/1975 | Cawley, Jr. et al. . | |
| 3,888,558 | 6/1975 | Himsl . | |
| 3,900,236 | 8/1975 | Goulish et al. . | |
| 3,941,441 | 3/1976 | Scheerhorn . | |
| 4,355,851 | 10/1982 | Slusser . | |
| 4,429,930 | 2/1984 | Blouin . | |
| 4,480,883 | 11/1984 | Young | 312/220 |
| 4,732,434 | 3/1988 | Hartrun | 312/217 |
| 4,772,078 | 9/1988 | Bowyer . | |
| 4,820,002 | 4/1989 | Lechner et al. . | |
| 4,865,404 | 9/1989 | Harper . | |
| 4,884,853 | 12/1989 | Bowyer . | |
| 4,936,640 | 6/1990 | Pratzer . | |
| 4,955,672 | 9/1990 | Pham . | |
| 4,957,334 | 9/1990 | Lakso | 312/221 |
| 4,960,309 | 10/1990 | Scheerhorn . | |
| 4,993,784 | 2/1991 | Dana et al. | 312/221 |
| 5,050,942 | 9/1991 | Frederick et al. . | |
| 5,056,876 | 10/1991 | Scheerhorn . | |

*Primary Examiner*—Kenneth J. Dorner
*Assistant Examiner*—Gerald A. Anderson
*Attorney, Agent, or Firm*—Andrus, Sceales, Starke & Sawall

[57] ABSTRACT

An interlock mechanism for a multi-drawer file cabinet assembly, for preventing more than one drawer from being opened at a time. The interlock mechanism includes a series of control rods mounted for axial movement within a series of blocks located in the interior of the cabinet. The control rods are arranged in an abutting end-to-end relationship, forming joints therebetween. A pivotable lever is mounted to the blocks adjacent each joint, and an actuator member is mounted to each drawer. Movement of a drawer to its open position causes engagement of the actuator member with one of the levers, to pivot it to a position in which the lever separates adjacent control rods, resulting in upward or downward movement of the control rods and vertical displacement of the joints between adjacent control rods. The remaining levers engage the control rods at a location spaced from a joint between control rods, to prevent the remaining drawers from being opened. Movement of the drawer back to its closed position causes engagement of the actuator member with the pivotable lever, to pivot the lever to its inoperative position out of engagement with the control rods. The control rods are returned to their original abutting position under the force of springs.

13 Claims, 3 Drawing Sheets 18
78
80
83
82
56
16
34
40
4
4
90
46
54
22
32
14
26
52
38
88
44
12
30
50
36
86
42
28
62
48
60
64
58
20
10
2
2
24
14
22
26
12
20
102
30
50
66
98
74
68
100
76
96
36
72
94
116
42
104
110
120
108
106
92
114
118
70
28
84
62
64
58
48
60

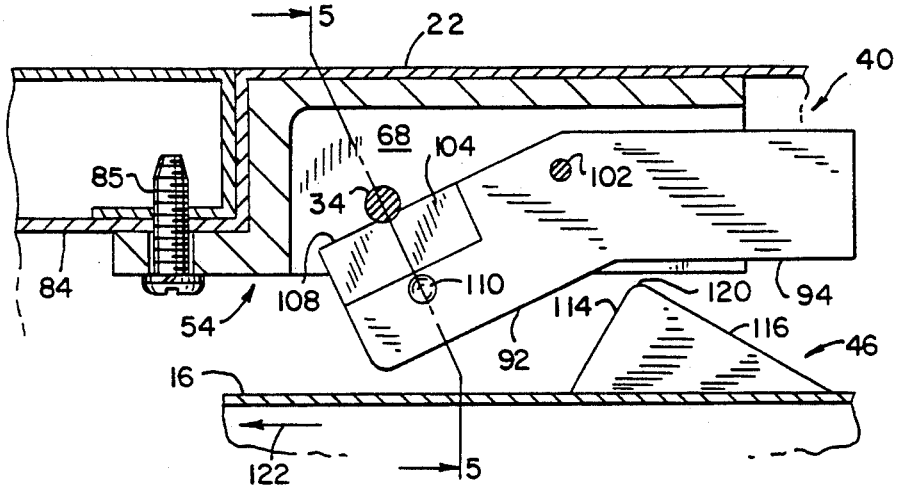
FIG. 4
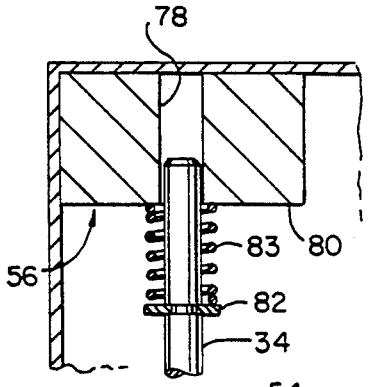
FIG. 5
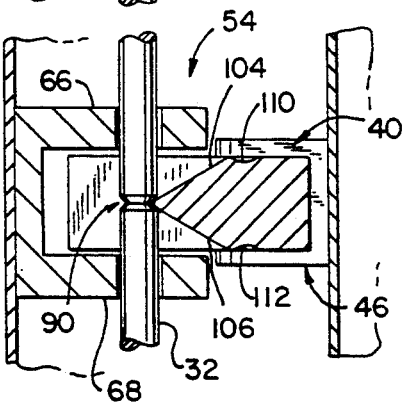
FIG. 6
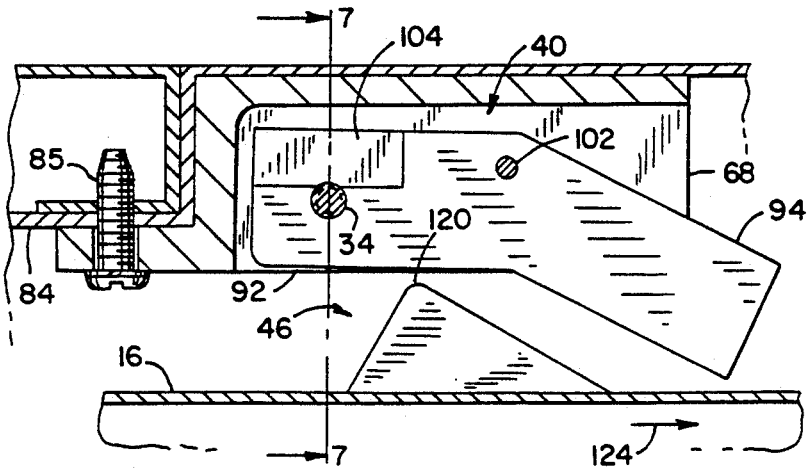

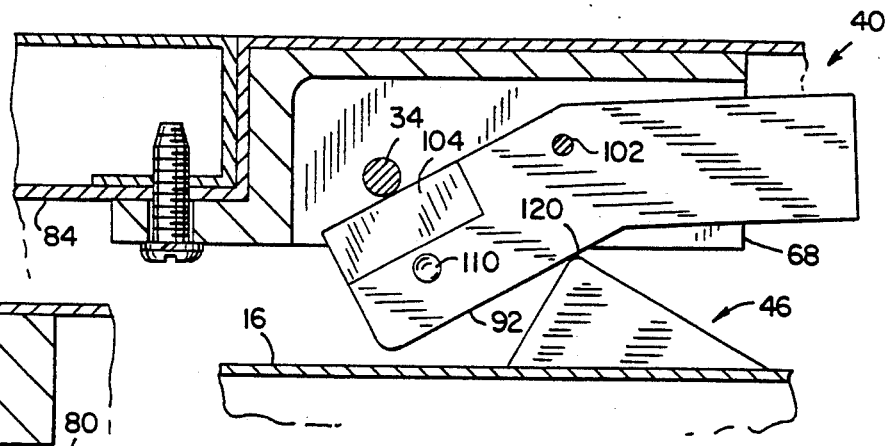
FIG. 8
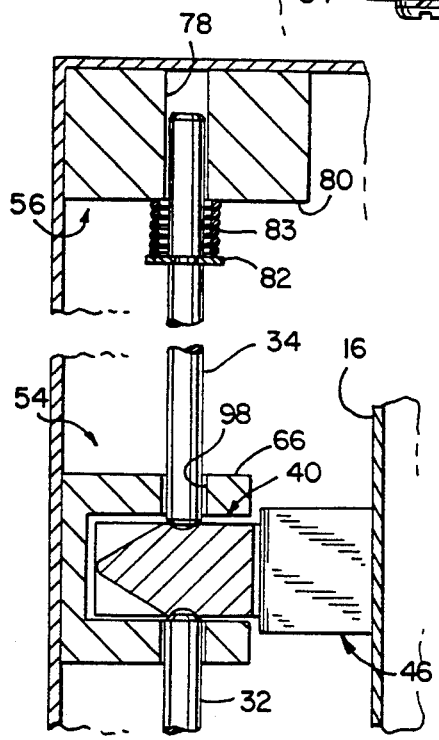
FIG. 7
FIG. 9
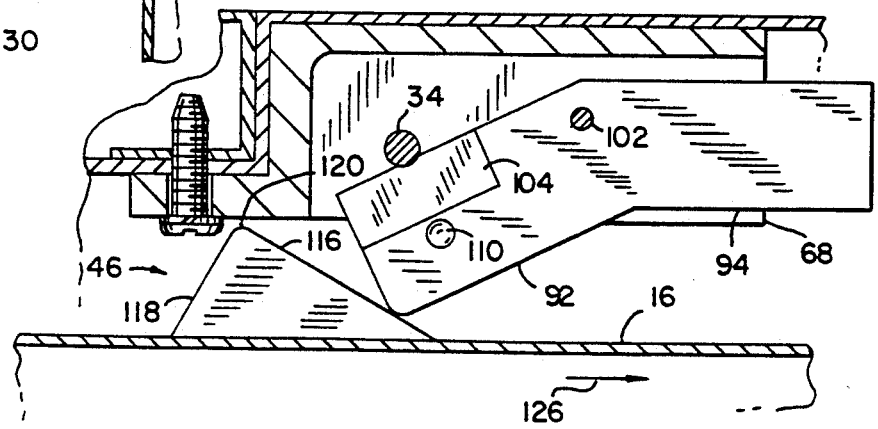

FILE DRAWER INTERLOCK MECHANISM

BACKGROUND AND SUMMARY

This invention pertains to an interlock mechanism for use in a cabinet having two or more drawers, for preventing more than one drawer at a time from being opened.

In a file cabinet having two or more drawers, it is known to provide an interlock mechanism for preventing more than one drawer from being opened at a time, in order to prevent tipping of the cabinet. Representative interlock mechanisms are shown in Frederick et al U.S. Pat. No. 5,050,942; Scheerhorn U.S. Pat. No. 4,960,309; Pratzer U.S. Pat. No. 4,936,640; and Bowyer U.S. Pat. No. 4,884,853.

It is an object of the present invention to provide an interlock mechanism which is relatively simple in its construction and operation, and which provides positive interlocking action and reliable operation.

In accordance with the invention, a series of control members are mounted to the cabinet and arranged in an abutting end-to-end relationship relative to each other to define a joint between each pair of adjacent control members. The control members are preferably in the form of elongated axial rods. A series of pivotable members, in the form of levers, are mounted to the cabinet, with each lever being located adjacent to, and in alignment with, a joint between adjacent control members. Each pivotable lever is movable between a first position and a second position. In its first position, the pivotable lever engages the two control members at the joint therebetween to move the control members apart, and in its second position allows the two control members to remain in their abutting end-to-end relationship. Upon movement of one of the pivotable levers to its first position to move two adjacent control members apart, each joint between the remainder of the control members is moved out of alignment with its adjacent pivotable lever, so that the control members prevent movement of each of the remaining pivotable levers to its first position. An actuator member is mounted to each drawer, and each actuator member is engageable with one of the pivotable levers. Movement of a first one of the drawers to its open position causes engagement of the actuator member mounted to the first drawer with one of the pivotable levers, to move the pivotable lever from its second position to its first position. With this arrangement, movement of any other drawer to its open position is prevented due to engagement of the remaining pivotable levers with the control members. Moving the first drawer to its closed position results in engagement of the actuator member with the pivotable lever, to move the pivotable lever back to its second position, thus returning the control members to their original position in which a joint between adjacent control members is again located in alignment with its adjacent pivotable lever.

The control members are mounted for axial movement within a series of blocks mounted to the cabinet. In addition, each pivotable lever is also mounted to one of the blocks, with each block defining a pair of spaced walls between which one of the pivotable levers is mounted. Passages are formed in the spaced walls of each block for receiving the control members, to guide the control members for axial movement. Bias means, in the form of a pair of springs, is interconnected with the control members for urging facing ends of adjacent control members toward each other. Movement of each pivotable lever to its first position functions against the force of the springs, to move adjacent control members apart.

Each lever defines first and second arms disposed at an angle relative to each other. The first arm is located adjacent the joint between a pair of control members and is engageable by the actuator member upon movement of the drawer to its open position, to move the lever toward its first position. The second arm is engageable by the actuator member upon movement of the drawer to its closed position, to move the lever toward its second position. The first arm of the lever includes wedge structure for facilitating its interposition between facing ends of adjacent control members, to move the control members apart upon movement of the lever to its first position. A detent is associated with the first arm adjacent the wedge structure, for receiving the facing ends of adjacent control members when the lever is in its first position.

The invention further contemplates a method of preventing movement of more than one drawer of a multi-drawer cabinet to its open position, substantially in accordance with the foregoing summary.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a partial section view taken along line 4—4 of FIG. 2, showing the pivotable lever in its second position;

FIG. 5 is a partial section view taken along line 5—5 of FIG. 4;

FIG. 6 is a view similar to FIG. 4, showing the pivotable lever in its first position in which the joint between adjacent control rods is separated by the pivotable lever;

FIG. 7 is a partial section view somewhat similar to FIG. 5, showing the pivotable lever in its first position;

FIG. 8 is a partial section view taken along line 8—8 of FIG. 7, showing engagement of the actuator member with the pivotable lever when another of the pivotable levers is in its first position, for preventing the drawer from being opened; and FIG. 9 is a view similar to FIGS. 4, 6 and 8, showing initial insertion of a file drawer into the cabinet.

DETAILED DESCRIPTION OF THE INVENTION

Figures 1, 2, 3:
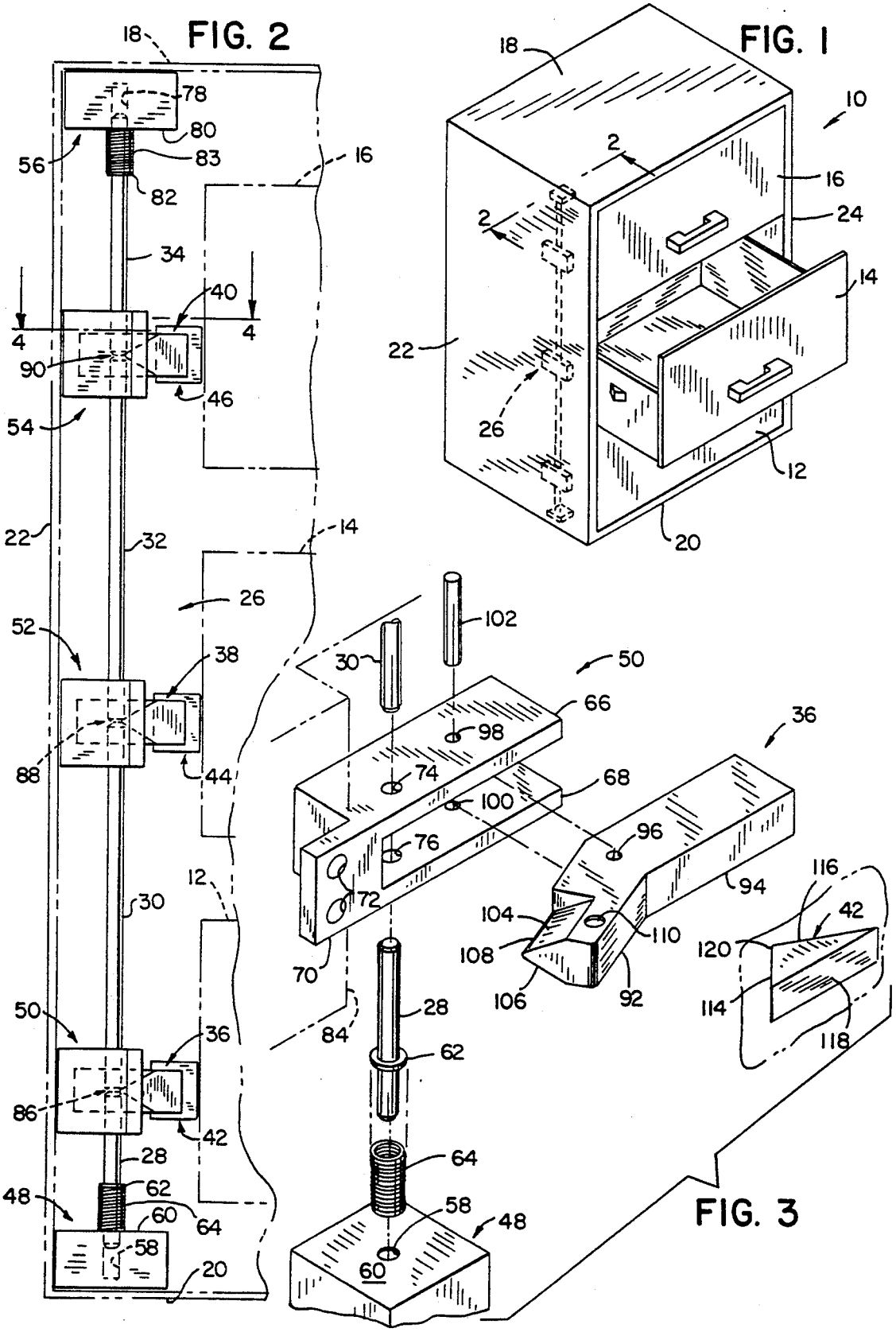
FIG. 1 is an isometric view of a multi-drawer file cabinet incorporating the interlock mechanism of the invention.
FIG. 2 is a partial elevation view showing the interlock mechanism of the invention as assembled within the interior of the file cabinet of FIG. 1.
FIG. 3 is an exploded isometric view of the lower portion of the interlock mechanism of FIG. 2.

FIG. 1 generally illustrates a file cabinet assembly 10 having a series of drawers 12, 14 and 16 mounted for sliding movement within a cabinet formed of an upper wall 18, a lower wall 20 and a pair of side walls 22, 24. Drawer slides, or any other satisfactory mechanism, are interposed between drawers 12, 14, 16 and cabinet walls 22, 24 for providing sliding movement of drawers 12, 14 and 16 between an open position and a closed position. Referring to FIG. 1, drawer 14 is illustrated in its open position, and drawers 12, 16 in their closed position.

An interlock mechanism, shown generally at 26, is interposed between the cabinet structure, specifically side wall 22, and each of drawers 12, 14 and 16. As will be explained, interlock mechanism 26 functions to prevent more than one of drawers 12, 14 and 16 from being opened at a time.

Referring to FIG. 2, interlock mechanism 26 includes a series of control rods 28, 30, 32 and 34, a series of pivotable levers shown generally at 36, 38 and 40, and a series of actuator members 42, 44 and 46 mounted to drawers 12, 14 and 16, respectively. Control rod 28 is mounted between a lower block 48 and a module block 50; control rod 30 is mounted between module block 50 and a module block 52; control rod 32 is mounted between module block 52 and a module block 54; and control rod 34 is mounted between module block 54 and an upper block 56. Each of control rods 28–34 provides a limited amount of axial upward and downward movement, in a manner to be explained, with control rods 28–34 being guided for axial movement by lower block 58, module blocks 50–54, and upper block 56.

Referring to FIG. 3, the lower end of control rod 28 is received within a passage 58 formed in upper surface 60 of lower block 48, which is fixed to the file cabinet at the corner defined by lower wall 20 and side wall 22. Lower block 48 can be mounted to either side wall 22 or to lower wall 20, or to both side wall 22 and lower wall 20, such as by screws or any other satisfactory mounting means. A stop 62 is fixedly mounted to control rod 28. A compression spring 64 is located between stop 62 and upper surface 60 of lower block 48.

With continued reference to FIG. 3, module block 50 defines an upper wall 66 and a lower wall 68, with a space therebetween. Block 50 further includes a mounting tab 70 defining a pair of passages 72 therethrough.

A pair of aligned passages 74, 76 are formed in upper wall 66 and lower wall 68, respectively, of module block 50. The upper end of control rod 28 is received within passage 76 in lower wall 68. The lower end of control rod 30 is received within passage 74 in upper wall 66.

Module blocks 52 and 54 are constructed identically to module block 50 as described, with aligned passages being formed in the upper and lower wall of each of control blocks 52, 54.

Upper block 56 is constructed similarly to lower block 48, having a passage 78 formed in its lower surface 80. The upper end of control rod 34 is received within passage 78. A stop 82 is fixedly mounted to control rod 34, and a compression spring 83 is disposed between stop 82 and lower surface 80 of upper block 56. Lower block 48, control blocks 50–54, and upper block 56 are mounted to the file cabinet structure, including side wall 22, such that control rods 28–34 are coaxially mounted within the interior of the file cabinet.

Module blocks 50, 52 and 54 may be mounted to the interior surface of cabinet side wall 22 in any satisfactory manner. For instance, when cabinet side wall 22 is formed of metal, module blocks 50, 52 and 54 may be spot welded to cabinet side wall 22. Alternatively, or in combination with spot welding, module blocks 50, 52 and 54 can be mounted to a vertical columnar member 84, formed integrally with or mounted to cabinet side wall 22, by means of threaded screws 85 (illustrated in FIG. 4) extending through openings 72 in mounting tab 70 and into aligned openings formed in columnar member 84. Lower and upper blocks 48, 56 are mounted to cabinet side wall 22 and cabinet lower and upper walls 20, 18, respectively in a similar manner. Alternatively, lower and upper blocks 48, 56 can be mounted to side wall 22 without contacting lower and upper walls 20, 18, respectively. It should also be appreciated that lower and upper blocks 48, 50 could be mounted or otherwise attached to module blocks 50, 54, respectively.

The facing ends of control rods 28 and 30 abut each other and define a joint 86 therebetween, located midway between upper wall 66 and lower wall 68 of module block 50. Similarly, the facing ends of control rods 30, 32 abut each other and define a joint 88 therebetween, located midway between the upper and lower walls of module block 52, and the facing ends of control rods 32, 34 abut each other and define a joint 90 located midway between the upper and lower walls of module block 54.

Springs 64, 84 function to bias control rod 28–34 together to define joints 86–90, and also to maintain joints 86–90 midway between the upper and lower walls of module blocks 50–54.

Referring again to FIG. 3, lever 36 defines a first arm 92 and a second arm 94. Arms 92, 94 are oriented at an angle relative to each other, with the longitudinal axes of arms 92, 94 defining an included angle of approximately 155° therebetween. A passage 96 extends through lever 36.

A second passage 98 is formed in upper wall 66 of module block 50, and a second passage 100, in axial alignment with passage 98, is formed in lower wall 68 of module block 50. Lever 36 is assembled to module block 50 by inserting lever 36 into the space between module block walls 66, 68, with passage 96 in lever 36 in alignment with passages 98, 100 in module block walls 66, 68, respectively. A pin 102 is inserted through passage 98 in upper wall 66, passage 96 in lever 36, and passage 100 in lower wall 68. Pin 102 is press-fit into passages 98, 100, and functions to pivotably mount lever 36 to module block 50.

Module blocks 52, 54 include passages identical to passages 98, 100 in upper and lower walls 66, 68 of module block 50, to receive a pin identical to pin 102 for pivotably mounting levers 38, 40 to module blocks 52, 54, respectively.

First arm 92 of lever 36 is provided with wedge structure at its outer end, defining an upper wedge surface 104 and a lower wedge surface 106. A rounded edge 108 extends between and separates wedge surfaces 104, 106. Wedge surface 104 extends between edge 108 and the upper surface of lever arm 92, and wedge surface 106 extends between edge 108 and the lower surface of lever arm 92. Wedge surfaces 104, 106 cooperate to define an included angle of approximately 75°.

A detent recess 110 is formed in the upper surface of lever arm 92, between the rearward edge of arm 92 and the line of merger between wedge surface 104 and the upper surface of lever arm 92. A similar detent recess 112 (shown in FIG. 5) is formed in the lower surface of lever arm 92, between the rearward edge of lever arm 92 and the line of merger between wedge surface 106 and the lower surface of lever arm 92.

Referring to FIG. 3, actuator member 42 is substantially triangular in plan, defining a forward angled surface 114, a rearward angled surface 116, and a mounting surface 118. Mounting surface 118 of actuator member 42 is engaged with the side wall of drawer 12, and actuator member 42 is mounted to drawer 12 such as by screws or the like extending through the side wall of drawer 12 and into threaded openings (not shown) formed in actuator member 42 extending inwardly from mounting surface 118. Angled surfaces 114, 116 define an included angle of approximately 90°. An edge 120 is formed at the vertex of actuator member 42 defined by angled surfaces 114, 116.

Actuator members 44 and 46 are constructed identically to actuator member 42 as illustrated in FIG. 3 and as described above. Accordingly, to facilitate clarity, the reference characters set forth with respect to actuator member 42 will be applied in the following paragraphs to actuator members 42 and 46.

Further pivotable levers 38 and 40 are constructed identically to pivotable lever 36 as illustrated in FIG. 3 and as described in detail above and, as noted previously, module blocks 52 and 54 are constructed identically to module block 50, as illustrated in FIG. 3 and as previously described in detail. Accordingly, to facilitate clarity, reference characters as set forth in the foregoing descriptions of lever 36 and module block 50 will be applied in the following paragraphs to levers 38, 40 and module blocks 52, 54, respectively.

Operation of interlock mechanism 26 is illustrated in FIGS. 4–9.

Each of levers 36, 38 and 40 is pivotable between an operative position, as illustrated in FIG. 6, and an inoperative position as illustrated in FIGS. 4 and 8.

FIGS. 4 and 5 illustrate the position of pivotable lever 40 when drawer 16 is in its closed position. In this position, the facing ends of control rods 32, 34 engage each other to form joint 90, located at the midpoint of the space defined between upper wall 66 and lower wall 68 of module block 54. Pivotable lever 40 is positioned such that edge 108, defined between wedge surfaces 104, 106, is horizontally aligned with joint 90, and is disposed within an angled space defined between bevels formed on the facing ends of control rods 32, 34.

When drawer 16 is opened, i.e. moved in the direction of arrow 122 (FIG. 4), actuator member 46 is moved into engagement with the rearward surface of lever arm 92, as illustrated in FIG. 8, wherein edge 120 defined between surfaces 114, 116 engages lever arm 92. Continued outward movement of drawer 16 causes edge 120 of actuator member 46 to move along the rearward surface of lever arm 92, such that pivotable lever 40 pivots about pin 102 to its operative position as illustrated in FIGS. 6 and 7. During such movement of lever 40 to its operative position, edge 108, between wedge surfaces 104, 106 of lever 40, moves horizontally to separate control rods 32, 34 at joint 90, resulting in movement of the facing ends of control rods 32, 34 along wedge surfaces 106, 104, respectively. When lever 40 is in its operative position, the lower end of control rod 34 has traveled the length of wedge surface 104 and is engaged within detent recess 110 formed in the upper surface of lever arm 92, as shown in FIG. 7. Similarly, the upper end of control rod 32 has traveled the length of wedge surface 106, and is disposed within detent recess 112 formed in the lower surface of lever arm 92 (FIG. 7). Control rod 34 is moved upwardly against the biasing force of spring 84, and is displaced upwardly within passage 78 formed in upper block 56. The lower end of control rod 34 remains disposed within passage 98 formed in upper wall 66 of module block 54.

Due to the abutting end-to-end relationship of control rods 28, 30 and 32, downward movement of control rod 32 likewise results in downward movement of control rods 28 and 30, and of joint 86 between control rods 28, 30 and joint 88 between control rods 30, 32, as illustrated in FIG. 7. Control rods 28, 30 and 32 are moved downwardly against the force of spring 64, with the lower end of control rod 28 being displaced downwardly within passage 58 formed in lower block 48.

When drawer 16 is opened to place pivotable lever 40 in its FIG. 7 position, it is not possible to open either of drawers 12, 14. For example, when drawer 12 is pulled outwardly, its actuator member 44 engages lever arm 92 of lever 38. Edge 108, defined by wedge surfaces 104, 106 of lever 38, engages control rod 32, with joint 88 between control rod 32 and control rod 30 having moved downwardly out of horizontal alignment with edge 108. Such engagement of edge 108 with control rod 32 prevents lever 38 from pivoting, and lever 38 in combination with actuator member 44 prevent drawer 14 from being opened. The same holds true with respect to drawer 12 and lever 36, with control rod 30 preventing pivoting movement of lever 36 to lock drawer 12 in its closed position.

When drawer 16 is moved toward its closed position, i.e. in the direction of arrow 124 (FIG. 6), edge 120 of actuator member 46 is moved rearwardly into engagement with the rearward surface of lever arm 94. Lever 40 is then pivoted counterclockwise about pin 102, resulting in the ends of control rods 34, 32 being disengaged from detent recesses 110, 112, respectively. The bevel provided on the ends of control rods 32, 34, in combination with the rounded shape of recesses 110, 112, facilitates disengagement of the ends of control rods 34, 32 from recesses 110, 112 when lever 40 is pivoted counterclockwise. Continued closing movement of drawer 16 moves lever 40 back to its FIG. 4 position, in which joint 90 between control rods 32, 34 is re-established, with the facing ends of control rods 32, 34 engaging each other and with edge 108 defined between wedge surfaces 104, 106 again being located in horizontal alignment with joint 90. Joints 86 and 88, between control rods 28, 30 and 30, 32, respectively are returned to their FIG. 2 position under the force of springs 64, 84. Thereafter, interlock mechanism 26 is in its position allowing any one of drawers 12, 14 or 16 to be opened.

It can be appreciated that levers 36 and 38 function identically to lever 40 as described. For example, when drawer 14 is opened to pivot lever 38 to its operative position, joint 90 between control rods 32, 34 is moved upwardly and joint 86 between control rods 28 and 30 is moved downwardly. Lever 40 thus engages control rod 32 to prevent drawer 16 from being opened, and lever 36 engages control rod 30 to prevent drawer 12 from being opened. When lever 36 is pivoted to its operative position, joints 88 and 90 between control rods 30, 32 and 32, 34, respectively, both are moved upwardly. Lever 38 engages control rod 30 to prevent drawer 14 from being opened, and lever 40 engages control rod 32 to prevent drawer 16 from being opened.

Control rod 28 is guided for axial movement within passage 58 in lower block 60 and within passage 76 formed in lower wall 68 of module block 50. Similarly, control rod 34 is guided for axial movement within passage 78 in upper block 80 and within passage 74 formed in upper wall 66 of module block 54. The lower end of control rod 30 is guided for axial upward and downward movement within passage 74 formed in upper wall 66 of module block 50, and the upper end of control rod 30 is guided for axial upward and downward movement within passage 76 formed in lower wall 68 of module block 52. The lower end of control rod 32 is guided for axial upward and downward movement within passage 74 formed in upper wall 66 of module block 52, and the upper end of control rod 32 is guided for axial upward and downward movement within passage 76 formed in lower wall 68 of module block 54.

It should be appreciated that interlock mechanism 26 could be used in a cabinet assembly having any number of drawers in which it is desired to prevent more than one drawer at a time from being opened. Further, it should be appreciated that interlock mechanism 26 could be installed on either the left side of the cabinet, as illustrated, or on the right side of the cabinet.

FIG. 9 of the drawings illustrates a situation in which drawer 16 is being installed within cabinet 10 for the first time, with drawer 16 being moved rearwardly toward its closed position in the direction of arrow 126. Lever 40 is in its inoperative position, with the facing ends of control rods 32, 34 engaging each other at joint 90. Angled surface 116 of actuator member 46 engages the inner corner of lever arm 92, which rides along angled surface 116 to move lever 40 to its operative position by pivoting lever 40 in a clockwise direction about pin 102, and lever 40 is positioned as shown in FIG. 7. Continued rearward movement of drawer 16 results in engagement of edge 120 of actuator member 46 with arm 94 of lever 40, which immediately results in lever 40 being pivoted counterclockwise back to its inoperative position. This allows subsequent one-at-a-time removal or installation of subsequent drawers.

Various alternatives and embodiments are contemplated as being within the scope of the following claims particularly pointing out and distinctly claiming the subject matter regarded as the invention.

I claim:

1. A drawer interlock for a cabinet, comprising:

a cabinet having two or more drawers, each drawer being movable between an open position and a closed position;

a plurality of elongated control members mounted to the cabinet and arranged in an abutting end-to-end relationship to define a joint between adjacent control members;

a plurality of pivotable members mounted to the cabinet, with each pivotable member being located adjacent a joint between two of the control members, each pivotable member pivotable about a pivot axes oriented substantially parallel to longitudinal axes of the control members, and being movable between a first position and a second position, wherein the pivotable member in its first position engages the two control members at the joint therebetween to move the control members apart, and in its second position allows the two control members to remain in abutting end-to-end relationship;

wherein movement of two of the control members apart by movement of one of the pivotable members to its first position causes movement of the joints between the remainder of the control members to prevent movement of each of the remaining pivotable members from its second position to its first position; and an actuator member mounted to each drawer, each actuator member being engageable with one of the pivotable members, wherein movement of a first one of the drawers to its open position causes engagement of the actuator member mounted to the first drawer with a first one of the pivotable members, to move the pivotable member from its second position to its first position to move two of the control members apart, and thereby prevent movement of any other drawer to its open position due to engagement of the pivotable members with the control members.

2. The drawer interlock of claim 1, wherein the plurality of control members comprise a series of aligned control rods, the control rods being mounted for axial movement within a plurality of blocks mounted to the cabinet.

3. The drawer interlock of claim 2, wherein each pivotable member is mounted to one of the blocks.

4. The drawer interlock of claim 3, wherein each block defines a pair of spaced walls, wherein a pivotable member is mounted between the pair of spaced walls of each block, and further comprising a guide opening associated with each wall within which one of the control members is located for guiding axial movement of the control members.

5. The drawer interlock of claim 1, wherein adjacent control members define facing ends, and further comprising bias means interconnected with the control members for urging the facing ends of adjacent control members together to define the joints between adjacent control members, wherein movement of one of the pivotable members to its first position functions against the force of the bias means to move two of the adjacent control members apart.

6. A drawer interlock for a cabinet, comprising:

a cabinet having two or more drawers, each drawer being movable between an open position and a closed position;

a plurality of control members mounted to the cabinet and arranged in an abutting end-to-end relationship to define a joint between adjacent control members;

a plurality of pivotable members mounted to the cabinet, with each pivotable member being located adjacent a joint between two of the control members, each pivotable member being movable between a first position and a second position, wherein the pivotable member in its first position engages the two control members at the joint therebetween to move the control members apart, and wherein the pivotable member in its second position allows the two control members to remain in abutting end-to-end relationship;

wherein movement of two of the control members apart by movement of one of the pivotable members to its first position causes movement of the joints between the remainder of the control members to prevent movement of each of the remaining pivotable members from its second position to its first position; and an actuator member mounted to each drawer, each actuator member being engageable with one of the pivotable members, wherein movement of a first one of the drawers to its open position causes engagement of the actuator member mounted to the first drawer with a first one of the pivotable members, to move the pivotable member from its second position to its first position to move two of the control members apart, and thereby prevent movement of any other drawer to its open position due to engagement of the pivotable members with the control members;

wherein each pivotable member comprises a lever defining a first arm and a second arm, the arms being at an angle to each other, wherein the first arm is located adjacent the joint between two control members and is engageable by the actuator member upon movement of the drawer to its open position to move the lever toward its first position, and wherein the second arm is engageable by the actuator member upon movement of the drawer to its closed position to move the lever toward its second position.

7. The drawer interlock of claim 6, wherein the first arm includes wedge structure for facilitating interposition of the first arm between facing ends of adjacent control members at the joint defined by the control members, to move the control members apart upon movement of the lever to its first position.

8. The drawer interlock of claim 7, further comprising a detent associated with the first arm adjacent the wedge structure for receiving the ends of adjacent control members when the lever is in its first position.

9. A drawer interlock for a cabinet, comprising:

a cabinet having two or more drawers, each drawer being movable between an open position and a closed position;

a plurality of elongated control members mounted to the cabinet and arranged in an abutting end-to-end relationship to define a joint between adjacent control members;

a one-piece lever mounted to the cabinet adjacent each joint, each lever being movable between a first position in which the lever engages the control members forming the joint for moving the control members apart, and a second position in which the lever is retracted out of engagement with the control members; and an actuator member mounted to each drawer and engageable with one of the levers, for moving the lever from its second position toward its first position upon movement of the drawer from its closed position to its open position, wherein movement of a first drawer to its open position results in movement of the lever from its second position to its first position to move the control members apart resulting in displacement of the joints between the remaining control members, and wherein movement of a second drawer toward its open position while the first drawer is in its open position results in engagement of the actuator member mounted to the second drawer with a second one of the levers and engagement of the second lever with one of the control members, to prevent movement of the second lever from its second position to its first position and to thereby prevent opening of the second drawer while the first drawer remains open.

10. The drawer interlock of claim 9, wherein each lever defines a first arm and a second arm, the arms being at an angle to each other, wherein the first arm is located adjacent the joint between two control members and is engageable by the actuator member upon movement of the drawer to its open position to move the lever toward its first position, and wherein the second arm is engageable by the actuator member upon movement of the drawer to its closed position to move the lever toward its second position.

11. The drawer interlock of claim 10, wherein the first arm includes wedge structure for facilitating engagement of the lever with the control members and movement of the control members apart.

12. The drawer interlock of claim 9, wherein each lever is pivotably mounted to the cabinet for movement about a pivot axis substantially parallel to the longitudinal axes of the control members.

13. A method of preventing movement of more than one drawer at a time to its open position in a cabinet having two or more drawers, each drawer being movable between an open position and a closed position, comprising the steps of:

mounting a plurality of elongated control members to the cabinet in an abutting end-to-end relationship relative to each other, wherein a joint is formed between each pair of adjacent control members;

mounting a plurality of pivotable members to the cabinet, each pivotable member being located adjacent a joint between two of the control members, wherein each pivotable member is pivotable about a pivot axis substantially parallel to longitudinal axes of the control members between a first position and a second position, and wherein the pivotable member in its first position engages the two control members at the joint therebetween to move the control members apart, and in its second position allows the two control members to remain in abutting end-to-end relationship;

wherein movement of two of the control members apart by movement of one of the pivotable members to tis first position causes movement of the joints between the remainder of the control members, so that the control members prevent movement of each of the remaining pivotable members to its first position; and moving a first one of the pivotable members to its first position by moving one of the drawers to its open position, to thereby prevent movement of any other drawers to its open position by engagement of the remaining pivotable members with the control members.

* * * * *

UNITED STATES PATENT AND TRADEMARK OFFICE

CERTIFICATE OF CORRECTION

PATENT NO. : 5,333,949

DATED : August 2, 1994

INVENTOR(S) : DICKSON J. McGREGOR

It is certified that error appears in the above-identified patent and that said Letters Patent is hereby corrected as shown below:

CLAIM 1, Col. 7, Line 54, after "member" insert -- being --; CLAIM 13, Col. 10, Line 47, delete "tis" and substitute therefor -- its --.

Signed and Sealed this

Eleventh Day of October, 1994

*Attest:*

*Attesting Officer*

Bruce Lehman

BRUCE LEHMAN

*Commissioner of Patents and Trademarks*